US006846381B2

(12) United States Patent
Jussila et al.

(10) Patent No.: US 6,846,381 B2
(45) Date of Patent: Jan. 25, 2005

(54) METHOD FOR CONTROLLING QUALITY OF PULP

(75) Inventors: Tero Jussila, Tampere (FI); Jouko Niinimäki, Oulu (FI)

(73) Assignee: Metso Paper, Inc., Helsinki (FI)

( * ) Notice: Subject to any disclaimer, the term of this patent is extended or adjusted under 35 U.S.C. 154(b) by 366 days.

(21) Appl. No.: 10/215,335

(22) Filed: Aug. 8, 2002

(65) Prior Publication Data

US 2003/0041984 A1 Mar. 6, 2003

Related U.S. Application Data

(63) Continuation of application No. PCT/FI01/00114, filed on Feb. 8, 2001.

(30) Foreign Application Priority Data

Feb. 11, 2000 (FI) ..... 20000293

(51) Int. Cl.[7] ..... D21D 5/02

(52) U.S. Cl. ..... 162/55; 162/49

(58) Field of Search ..... 162/52, 23, 28, 162/49, 198, 254, 258, 61; 241/28, 33, 34–37

(56) References Cited

U.S. PATENT DOCUMENTS 4,626,318 A * 12/1986 Prough et al. ..... 162/49

FOREIGN PATENT DOCUMENTS

WO WO 93/25752 12/1999

* cited by examiner

*Primary Examiner*—Steven P. Griffin
*Assistant Examiner*—Kara Parker
(74) *Attorney, Agent, or Firm*—Alston & Bird LLP

(57) ABSTRACT

A method for controlling the quality of pulp. Pulp produced by mechanical defibering of wood is screened to provide at least two fractions, of which the accept that has passed the screening phase is carried forward for use and the reject that has not passed the screening is removed from the screening phase. The consistency of the reject that is to be removed from the screening is measured and the consistency value thus obtained is used for controlling the defibrator to adjust the quality of the accept.

9 Claims, 2 Drawing Sheets

METHOD FOR CONTROLLING QUALITY OF PULP

CROSS REFERENCE TO RELATED APPLICATION

This application is a continuation of International Application PCT/FI01/00114 filed on Feb. 8, 2001, which is hereby incorporated herein by reference and which designated inter alia the United States and was published under PCT Article 21(2) in the English language.

FIELD OF THE INVENTION

The invention relates to a method for controlling the quality of pulp during production thereof, wherein a mechanical defibering process is carried out to produce a pulp and then a screening process is carried out on the pulp to provide at least two fractions, namely, an accept fraction (also referred to simply as "accept") that passes the screening process and is carried forward for later use, and a reject fraction (also referred to simply as "reject") that does not pass the screening phase and is led out of the screening process.

BACKGROUND OF THE INVENTION

In modern mechanical defibering of wood, pulp is screened under pressure to keep the quality of the accepted pulp, or accept, uniform. This may be carried out by controlling the amount of mass, i.e., the level of the mass surface, in the feeder or accept containers in the screening. Other alternatives include adjustments based on screening pressure and mass flow. In principle, these methods only control the capacity of the screening which is not, as such, in any way directly proportional to the quality of the screened pulp. Another way to control the screening such that the quality of the accepted pulp is also maintained as uniform as possible, irrespective of capacity variations, is based on the values of the flow-to-reject ratio and the feed consistency of the pulp supplied to the screening.

Although the adjustments used in prior art process control methods may be applied in standard or normal operating conditions, they cannot be used for controlling the process in exceptional circumstances, for example when refiners or grinding machines (referred to herein generically as "defibrators") are switched on or off. Consequently, since in some cases a facility may comprise several defibrators, the quality of pulp can vary significantly, thereby affecting the further processes and the quality of the fibrous web made from the pulp.

SUMMARY OF THE INVENTION

It is an object of the present invention to provide a method that allows the quality of the pulp leaving the screen section to be controlled with greater precision than before, taking different kinds of sudden variations also into account. The method of the invention is characterized by measuring the consistency of the reject that is to be removed from the screening, the consistency value thereby obtained being used for controlling the defibrator to adjust the quality of the accept.

In accordance with the invention, the properties of the reject formed after the screening are determined and are used as a basis to control the defibering. An advantage of the invention is that, irrespective of variations in the properties of the mass to be fed, the inventive method allows the properties of the acceptable mass fraction to be kept more-uniform than before and, thereby, to improve the quality of both the further process and the fibrous web to be manufactured. In a preferred embodiment of the invention, the consistency of the reject mass leaving the screening phase is measured and is used as a basis to control the defibering, preferably on the basis of the variations in the reject's consistency. An essential idea of a second preferred embodiment of the invention is to measure the consistency of the reject and to determine a reject flow either by direct or indirect measurement, the defibering then being controlled on the basis of the values thus obtained. According to a third preferred embodiment of the invention, the consistency is also measured and the flow determined from the pulp to be supplied to the screening, the values thus obtained and the reject values then being used for calculating a reject ratio to be used for controlling the defibering.

BRIEF DESCRIPTION OF THE DRAWINGS

The invention will be described in greater detail with reference to the accompanying drawings, in which.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
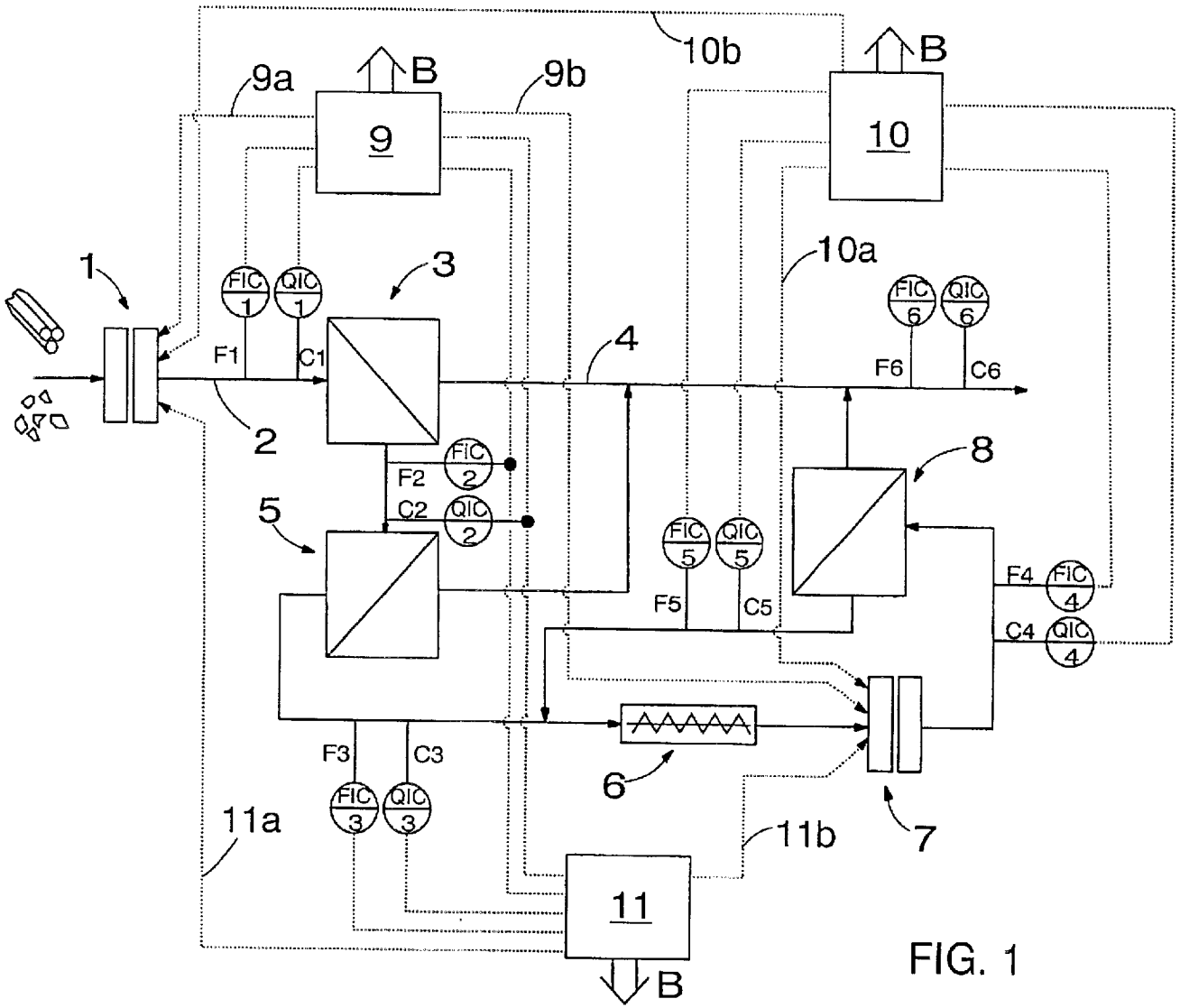
FIG. 1 is a schematic view of a screening and control according to the invention of pulp leaving mechanical defibering.

In FIG. 1 wood is defibered in the presence of water in a primary defibrator 1 to produce pulp either by grinding wood in a grinding machine or by refining wood chips, depending on whether the primary defibrator 1 is a grinding machine or a refiner. There may be one or more primary defibrators 1, and they may be all alike or, if necessary, different types of primary defibrators may be used to form a primary defibrator entity, hereinafter referred to as a primary defibrator.

From the primary defibrator 1 the pulp is carried via a feed conduit 2 to a first screening phase 3 where it is divided into two fractions. The accepted mass fraction, or the accept, is led to a discharge conduit 4, whereas the rejected mass fraction, or the reject, is led to a second screening phase 5. The accepted mass fraction, or the accept, obtained from the second screening phase is again led to the discharge conduit 4 and the reject is carried forward to a thickener 6 and then to a defibrator, i.e. a reject refiner 7. The reject refined in the reject refiner 7 is then supplied to a reject screening phase 8, the accepted mass fraction obtained there being led to the discharge conduit 4 and, correspondingly, the rejected mass fraction, or the reject, fed together with the reject from the second screening phase to the thickener 6 and then again to the reject refiner 7.

As shown in the Figure, flow and consistency values $F_1$ and $C_1$ of the pulp to be fed are measured using measuring sensors $FIC_1$ and $QIC_1$ to obtain the amount of incoming pulp. In addition, flow amount $F_2$ and consistency $C_2$ of the reject leaving the first screening phase 3 is measured using measuring sensors $FIC_2$ and $QIC_2$ to allow the reject ratio produced in the first screening phase to be calculated. After the second screening phase 5, flow amount $F_3$ and consistency $C_3$ of the reject are measured using measuring sensors $FIC_3$ and $QIC_3$. Flow amount $F_4$ and consistency $C_4$ of the pulp to be supplied to the reject screening phase being then measured after the reject refiner 7 using measurement sensors $FIC_4$ and $QIC_4$, and flow amount $F_5$ and consistency $C_5$ of the reject leaving the reject screening using measurement sensors $FIC_5$ and $QIC_5$, sufficient values for controlling the entire defibering process are obtained. Furthermore, flow amount $F_6$ and consistency $C_6$ of the pulp flowing to the paper machine via the discharge conduit 4 may be measured using measurement sensors $FIC_6$ and $QIC_6$, and the values thereby obtained may be used for monitoring the adjustments and the rest of the process. The Figure also shows control unit 9 to which the measurement sensors of the reject of the first screening phase 3 and the pulp to be fed are connected, the unit itself being connected to control the primary defibrator 1 as shown by line 9*a*. Control unit 9 is also connected to control the reject refiner 7, as shown by line 9*b*. The Figure also includes control unit 10 to which measurement sensors of the pulp coming from the reject refiner 7 to be supplied to the reject screening phase 8 and, correspondingly, the reject mass leaving the reject screening phase are connected, the unit being connected to control the reject refiner 7, as schematically shown by line 10*a*. Control unit 10 is also connected to control the primary defibrator 1, as shown by line 10*b*. The Figure further includes control unit 11 to which measurement sensors for the reject coming from the second screening phase 5 and the reject coming from the reject screening phase 8 are connected, as well as the measurement sensors of the pulp to be supplied to the screening phases 5 and 8. The control unit 11 is further connected to control the primary defibrator 1 and the reject refiner 7, as shown schematically by lines 11*a* and 11*b*, respectively. Instead of the measurement of flow amount, also methods indirectly determining the flow amount may be used, such methods being based on pressure loss, for example, or on some other known physical phenomenon. Such methods for determining flow are commonly known and therefore they do not need to be described in greater detail in this context.

Changes in the measurements of consistency $C_2$ of the reject in the first screening phase allow to deduct that the quality of the pulp coming from the primary defibrator 1 to the first screening phase 3 is changing. Control unit 9 can thus use the measurement of consistency $C_2$ alone to control the primary defibrator 1 such that the quality of the pulp regains its original value. Changes taking place in the consistency may also cause corresponding changes in the quality of the pulp material leaving the reject refiner 7. The reject refiner 7 can then be adjusted, if desired, so that the quality of the accept leaving the reject screening phase 8 remains substantially unchanged. Similarly, any changes in consistency $C_5$ observed by measuring the consistency of the reject leaving the reject screening phase 8 may used for controlling the reject refiner 7 such that the quality of the pulp leaving the refiner and to be supplied to the reject screening phase remains substantially as desired.

In addition to applying control based on the measurement of consistency alone, the reject flow may be determined, either by directly measuring the flow or indirectly by measuring pressure loss, or by using some other suitable measurement method. This allows changes both in consistency and flow to be used as a basis of the defibrator adjustments. Furthermore, the consistency of the pulp to be fed to the screening phase and the reject consistency may be measured to control the defibrators on the basis of the consistencies. According to a preferred embodiment, the values of both the reject consistency and flow and, correspondingly, the values of the consistency and flow of the pulp to be fed to the screening phase are used to calculate a mass-to-reject ratio.

Any change in the mass-to-reject ratio is proportional to the freeness value of the pulp to be supplied to the screening; for example, a rise in the reject ratio means that the freeness value of the supplied pulp has risen and, correspondingly, a decrease in the reject ratio means that the freeness value has decreased. Changes in the reject ratio can thus be used for controlling the defibrator from which the pulp comes to the screen in question. The simplest way to perform this is to adjust the specific energy consumption (SEC) or the power of the defibrator in question, such as the grinding machine or refiner, to a direction that will provide the desired freeness value for the accept. When a substantially constant freeness value is to be maintained for the accept, the specific energy consumption or the power is adjusted so that the defibering produces a change in the freeness value generated in the defibering which is inversely proportional to the change in the reject ratio. The control units 9, 10 and 11 in the Figure are further provided with an arrow marked with letter B to indicate that the control units may be interconnected in a suitable manner to provide a control unit entity that allows a comprehensive control of the defibrators to be implemented. The control units may also be connected to a general control and monitoring system in the manufacturing plant to appropriately control and monitor the entity.

The pulp entering the screening comes from the primary defibrator 1 which can be controlled using the reject ratio of the first screening phase 3. The reject ratio is calculated on the basis of flow values $F_1$ and $F_2$ and consistency values $C_1$ and $C_2$. If the operation of the screen is based on a constant volume-to-reject ratio, the mass-to-reject ratio may be determined using the formula $$RR_m = \frac{C_R F_R}{C_F F_F} \tag{1}$$

wherein $RR_m$=mass-to-reject ratio $F_R$=amount of reject flow (dm ³⁄₅)

$F_F$=amount of flow of pulp fed (dm ³⁄₅)

$C_R$=consistency of reject, %

$C_F$=consistency of pulp fed, %

Accordingly, reject ratio $RR_{m1}$ for the first screening phase is calculated using the formula $$RR_{m1} = \frac{C_2 F_2}{C_1 F_1} \tag{2}$$

The reject ratio value thus calculated may be used for controlling the primary defibrator 1 with the control unit 9. To implement this, the values measured at the measurement sensors $FIC_{1\text{-}2}$ and $QIC_{1\text{-}2}$ are fed to the control unit 9 where the calculations are carried out. The control unit 9 then controls the primary defibrator 1 by adjusting its specific energy consumption such that, if the freeness value of the accept is to be kept constant when the reject ratio increases, the specific energy consumption is increased, as a result of which the freeness value of the pulp produced by the defibering decreases. Correspondingly, if the reject ratio tends to decrease, the specific energy consumption is reduced, whereby the freeness value of the pulp produced by the defibering increases. Similarly, the adjusting of the specific energy consumption allows the freeness value to be changed to the desired direction, and after the adjustment it can then be kept substantially constant according to the above principle.

To adjust the reject refiner 7, the reject ratio generated in the reject screening may be used. Sensors $FIC_4$ and $QIC_4$ are used for measuring flow $F_4$ and consistency $C_4$ of the pulp to be fed to the reject screening and sensors $FIC_5$ and $QIC_5$ for measuring the amount of flow $F_5$ and consistency $C_5$ of the reject mass. These may then be used in formula $$RR_{m2} = \frac{C_5 F_5}{C_6 F_6} \tag{3}$$

for calculating reject ratio $RR_{m2}$ for the reject screening to be used for adjusting the specific energy consumption of the reject refiner 7 such that when the reject ratio increases, the specific energy consumption is increased and, correspondingly, when it decreases, the consumption is reduced to allow the freeness value of the pulp obtained from the reject refiner to be kept substantially constant. Control unit 10 to which measurement sensors $FIC_{4\text{-}5}$ and $QIC_{4\text{-}5}$ are connected and which is connected to control the reject refiner 7 is used for this purpose. The Figure also shows that control unit 11 may be used in screening phase 2 for measuring and calculating the reject ratio according to the above examples, the control unit being in turn capable of controlling both the primary defibrator 1 and the reject refiner 7. Each of the control units 9, 10, 11 thus forms a separate entity controlling the operation of a specific screening phase on the basis of which they determine the quality of the pulp. This allows the production of pulp by the defibrators to be controlled to ensure desired quality and, correspondingly, to maintain the quality substantially constant. In practice the control units 9, 10, 11 may be integrated in one and the same control equipment and/or form for example a part of a controller provided with software and used for managing the process as a whole.

The Figure shows a typical three-phase screen in which the pulp is screened in two consecutive screening phases or screens, the reject thereby produced being then screened in a separate reject screening phase. However, the basic idea of the invention may also be applied in other kinds of screens in which the properties of the accept and reject can be measured or determined following the described principle. The different screening phases may comprise either separate screens or multi-phase screens forming one entity, or other kinds of screen combinations. The control units may be connected to control the defibrators either directly or according to the principle of above mentioned bus B, a specific refiner being controlled either by a single control unit or the impact of a plural number of control units is taken into account. By way of example, control unit 9 may thus provide 70% of the control of the primary defibrator 1, control unit 10 providing 20% and control unit 11 10%. Similarly, the reject refiner 7 may be controlled by control unit 10 to 60%, by control unit 11 to 20% and by control unit 9 to 20%. Different decisions regarding whether percent adjustments or relative adjustments are applied can be made, as need arises, so that the equipment as a whole is taken into account, which allows the best possible result to be obtained with regard to any desired quality characteristic of the pulp. As shown in FIG. 1, changes in the reject ratio may be similarly considered proportional to other mass properties, such as the proportion of long fibres in the mass, mass strength etc. The reject ratio can thus be used, when desired, also for controlling these quality values of the pulp.

Figure 2B:
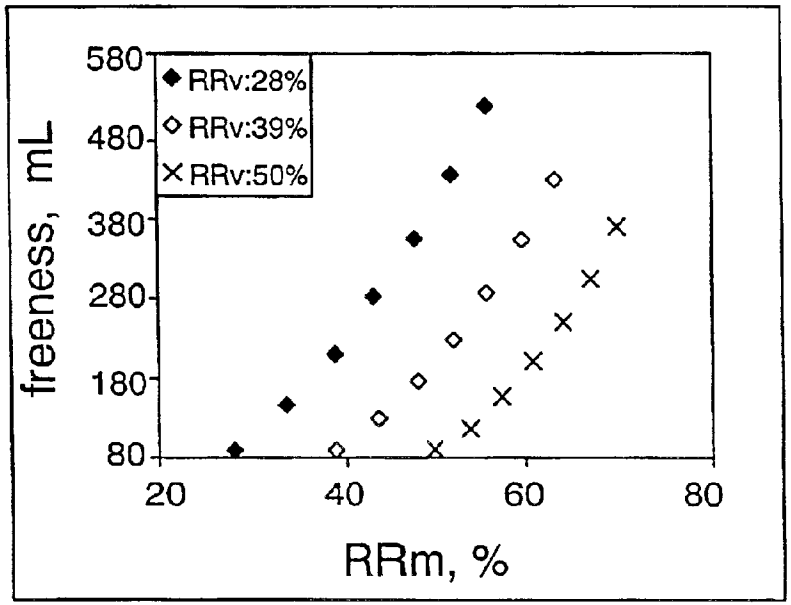
FIGS. 2*a* and 2*b* are schematic views of the interdependence of some parameters used in the control.
Figure 2A:
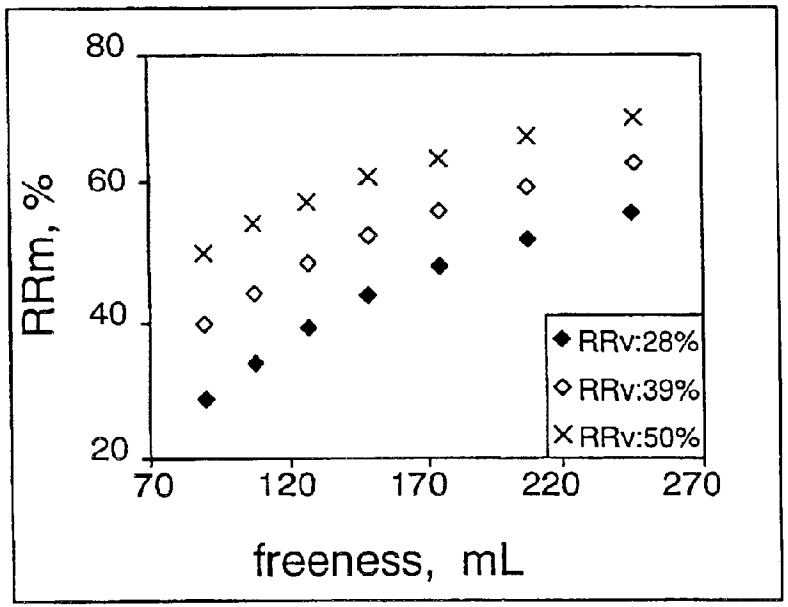

FIGS. 2*a* and 2*b* schematically illustrate the interrelated effect of parameters associated with the implementing of the method of the invention. FIG. 2*a* shows three reject ratio values which illustrate the interdependence of the mass-to-reject ratio and the freeness value of the pulp fed to the screening phase in a screening where the reject-to-accept volume ratio is constant. As shown in the Figure, mass-to-reject ratio $RR_m$ increases as the freeness value of the fed pulp increases. The same interdependence is valid for all reject-to-volume ratio values, although the position and form of the curves drawn on the basis of the measurement points differ to some extent at different reject-to-volume ratios $RR_v$, mass-to-reject ratio $RR_m$ being higher at a higher reject-to-volume ratio $RR_v$ than the ratio calculated using a corresponding freeness value at low volume-to-reject ratios. FIG. 2*b* in turn illustrates the interdependence of the freeness value of the reject and mass-to-reject ratio $RR_m$ in a screening situation corresponding to that of FIG. 2*a*. The Figure shows, correspondingly, that the freeness value of the reject increases as the mass-to-reject ratio increases, and, the higher the reject-to-volume ratio $RR_v$, the lower is the freeness of the reject at a specific mass-to-reject ratio value.

FIGS. 2*a* and 2*b* thus illustrate, on one hand, the interdependence of changes in the reject properties, i.e. in consistency and flow, and the freeness of the pulp to be fed, and, on the other hand, that the different reject properties, i.e. consistency and flow, are proportional to the freeness value of the reject. This allows the reject properties to be used for controlling the primary defibering and the reject refining, the pulp to be formed thus having properties that render it better suited for further processing.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for controlling the quality of pulp during production thereof in which a mechanical defibering process is carried out using at least one defibrator to produce a pulp and then a screening process is carried out on the pulp to provide at least two fractions including an accept that passes the screening process and is carried forward for later use, and a reject that does not pass the screening process and is led out of the screening process, the method comprising the steps of:

measuring a consistency value of the reject that is to be removed from the screening process; and using the measured consistency value of the reject as a basis for controlling the defibrator so as to control the quality of the accept.

2. A method according to claim 1, further comprising the step of determining a value for flow of the reject and controlling the defibrator on the basis of the values of both the consistency and the flow of the reject.

3. A method according to claim 1, comprising the step of measuring from the pulp fed to the screening process values corresponding to those measured from the reject, and controlling the defibrator on the basis of the values of both the fed pulp and the reject.

4. A method according to claim 3, wherein amounts of flow are determined for the pulp fed to the screening and, correspondingly, for the reject to be removed from the screening and respective consistencies of the pulp fed to the screening and of the reject are measured, and wherein the amounts of flow and the consistency values are used for calculating a reject ratio of the reject to the fed pulp, and the defibrator is controlled on the basis of said reject ratio.

5. A method according to claim 4, wherein controlling quality of the accept comprises controlling at least one of freeness and fiber length of the accept.

6. A method according to claim 5, wherein to maintain a substantially constant freeness value for the accept, specific energy consumption of the defibrator is controlled such that when the reject ratio increases, the specific energy consumption of the defibrator is increased and, correspondingly, when the reject ratio decreases, the energy consumption of the defibrator is reduced.

7. A method according to claim 1, wherein controlling the defibrator comprises controlling at least one of specific energy consumption and power of the defibrator.

8. A method according to claim 1, further comprising the steps of subjecting the reject to a reject screening process and processing reject from said reject screening process in a reject refiner, determining a reject ratio for the reject screening process, and controlling the reject refiner based on the reject ratio of the reject screening process.

9. A method according to claim 1, wherein at least the consistency value of reject from a single screening process is used for controlling a plurality of defibrators producing pulp to be screened.

* * * * *